United States Patent [19]

Chino et al.

[11] 4,353,533

[45] Oct. 12, 1982

[54] BOTTOM TUYERES IN AN OXYGEN TOP-BLOWN CONVERTER

[75] Inventors: Tatsukichi Chino; Takuo Imai; Masaaki Tsukamoto; Ryuichi Asaho; Nagayasu Bessho; Kyoji Nakanishi, all of Chiba, Japan

[73] Assignee: Kawasaki Steel Corporation, Kobe, Japan

[21] Appl. No.: 234,919

[22] Filed: Feb. 17, 1981

[30] Foreign Application Priority Data

Feb. 18, 1980 [JP] Japan ..... 55-18188[U]

[51] Int. Cl.[3] ..... C21C 5/58

[52] U.S. Cl. ..... 266/265; 75/59; 75/60

[58] Field of Search ..... 266/265–267; 75/52, 59, 60

[56] References Cited

U.S. PATENT DOCUMENTS

| | | | |
|---|---|---|---|
| 3,781,002 | 12/1973 | Courard | 266/268 |
| 3,854,932 | 12/1974 | Bishop | 75/60 |
| 4,280,838 | 7/1981 | Marukawa | 75/52 |

*Primary Examiner*—P. D. Rosenberg

*Attorney, Agent, or Firm*—Balogh, Osann, Kramer, Dvorak, Genova & Traub

[57] ABSTRACT

A tuyere for blowing an agitating gas into molten steel is arranged in the bottom of an oxygen top-blown converter in order to improve the refining effect of molten steel and has a ratio of blow sectional area S ($cm^2$) to inner peripheral length L (cm) of not more than 0.17, preferably not more than 0.125.

5 Claims, 6 Drawing Figures

BOTTOM TUYERES IN AN OXYGEN TOP-BLOWN CONVERTER

This invention relates to an improvement of a bottom tuyere in an oxygen top-blown converter, and more particularly to bottom tuyeres used for introducing an agitating gas into molten steel so as to promote the uniformity of molten steel composition during or after the oxygen blowing as well as reactions inside the converter.

In pure oxygen top-blown converters, there has lately been a new operational process wherein a gas blowing equipment is mainly arranged in the bottom of the converter and a gas such as oxygen, nitrogen, hydrocarbon, carbon dioxide, argon or a mixture thereof is passed through the gas blowing equipment to enhance the agitation of molten steel during the oxygen blowing.

As the gas blowing equipment, there have hitherto been used a porous plug, a concentric double pipe tuyere and the like. However, the porous plug is made of a refractory having a high porosity, which is poor in the thermal resistance and durability as compared with a refractory having a high density, so that there is a serious problem in the use-life when considering that the operation number of the recent converter extends to about 2,000 times. On the other hand, in case of using the double pipe tuyere, a hydrocarbon gas for cooling is passed through an annular passage between an outer pipe and an inner pipe, and a reactive gas such as oxygen and the like or an inert gas is passed through a center passage of an inner pipe, so that there is caused a fear that hydrogen generated from the hydrocarbon gas remains in molten steel. For this reason, there is proposed a so-called AOD process wherein an argon gas is passed through the annular passage. In this case, the above mentioned problem due to hydrogen is avoided, but the melting loss of the refractory surrounding the outer pipe becomes large due to the poor cooling, which causes a trouble in the tuyere life, and the cost of argon gas is expensive, so that this process is mainly applied only to the refining of stainless steel and is not used for ordinary steels at all. Further, when the inert gas is simultaneously through both the inner and outer pipes of the double pipe tuyere, the clogging of the tuyere is apt to occur due to excessive cooling by the inert gas and then the melting loss of the refractory surrounding the tuyere becomes increased due to the clogging of the tuyere. Moreover, the sectional area of the double pipe tuyere is large owing to the practical working matter, and hence the quantity of inert gases used is large in the industrially used converter. That is, the gas is actually used in the quantity of 0.1–1.0 $Nm^3$/min.ton for the central passage and about 0.1 $Nm^3$/min.ton for the annular passage.

If oxygen gas is passed through a single pipe tuyere, the melting loss of the tuyere and the surrounding refractory becomes conspicuous because the cooling gas cannot be used differently from the case of the double pipe tuyere. Thus, the utilization of a single pipe tuyere for blowing oxygen gas has not yet been put to practical use.

On the other hand, consideration has been given to the use of a single pipe tuyere for the blowing of an agitating gas in an oxygen top-blown converter. In this case, it is necessary to cool the tuyere itself and as a result, a great amount of the agitating gas is required to be passed at a sufficiently high blowing rate with the increase of the tuyere diameter. However, the agitating gas does not bring with it a violent exothermic reaction as in the case of oxygen gas, so that the temperature of molten steel near the tuyere is lowered to produce a large amount of metal deposit, which finally brings about the clogging of the tuyere.

It is, therefore, an object of the invention to provide a bottom tuyere suitable for use in an oxygen top-blown converter having a simple structure without the clogging of the tuyere due to the overcooling of molten steel.

According to the invention, there is the provision of a bottom tuyere usable in an oxygen top-blown converter, wherein the improvement resides in the tuyere having a ratio of blow sectional area S ($cm^2$) to inner peripheral length L (cm) of not more than 0.17.

In a preferred embodiment of the invention, the bottom tuyere has a ratio of blow sectional area to inner peripheral length of not more than 0.125, whereby not only the formation of metal deposit and hence the clogging of the tuyere is completely prevented, but also the leakage of molten metal through the tuyere can be prevented and the melting loss of the tuyere and its surroundings can be considerably reduced to prolong the tuyere life.

The invention will now be described in greater detail with reference to the accompanying drawings, wherein.

In the bottom tuyere for oxygen top-blown converters, an agitating gas such as inert gas or the like passing through the tuyere is usually at room temperature or less owing to the temperature drop due to the adiabatic expansion. During the blowing of the agitating gas, heat exchange is conducted due to the temperature difference between the agitating gas and molten steel being a temperature of usually 1,600° C., whereby molten steel is locally cooled and solidified around the tuyere to form a metal deposit.

Figure 1:
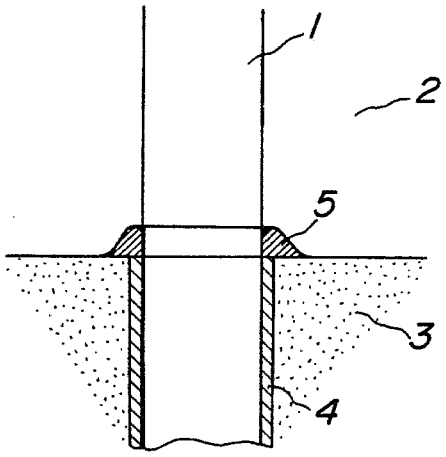
FIGS. 1 and 2 are schematic cross sectional views of an embodiment of the bottom tuyere used in the oxygen top-blown converter.

In FIG. 1 is sectionally shown the tuyere arranged in the bottom of the oxygen top-blown converter, wherein numeral 1 is a blown gas stream, numeral 2 molten steel, numeral 3 a refractory arranged in the bottom of the converter, numeral 4 a bottom tuyere and numeral 5 a metal deposit formed around the tuyere.

Figure 2:
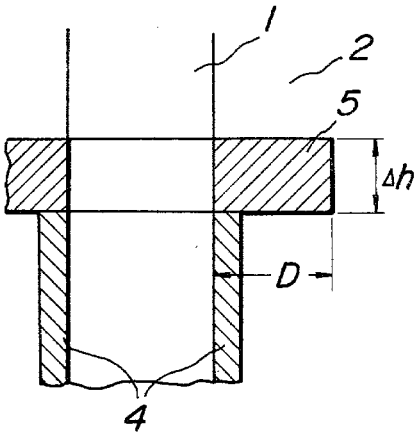

Now, the formation of the metal deposit 5 is examined with reference to FIG. 2. In this case, the blowing conditions are as follows:

| | |
|---|---|
| Blow sectional area of tuyere | S ($cm^2$) |
| Inner peripheral length of tuyere | L (cm) |
| Specific gravity of molten steel | $\delta_s$ ($g/cm^3$) |
| Specific gravity of agitating gas | $\delta_g$ ($g/cm^3$) |
| Specific heat of molten steel | $C_s$ (cal/g) |
| Specific heat of agitating gas | $C_g$ (cal/g) |

-continued

| Blowing linear velocity of agitating gas | V (cm/sec) |
|---|---|

Assuming that the metal deposit 5 having a square section with a thickness of D (cm) grows only by Δh (cm) per unit time t (sec) during the blowing of the agitating gas and a latent heat of metal solidification is $H_s$ (cal/g), there is established the following equation (1):

$$\Delta h \times D \times L \times \delta_s \times H_s = v \times S \times C_g \times \delta_g \times \Delta T_g \quad (1)$$

wherein $\Delta T_g$ is a temperature rising (°C.) of the agitating gas per unit time. Then, the equation (1) is modified to obtain the following equation (2):

$$\Delta h = \frac{S}{L} \times \frac{v \times C_g \times \delta_g \times \Delta T_g}{D \times \delta_s \times H_s} \quad (2)$$

Thus, it is apparent from the equation (2) that the growing rate of the metal deposit 5 is proportionate to the ratio S/L.

Figure 3:
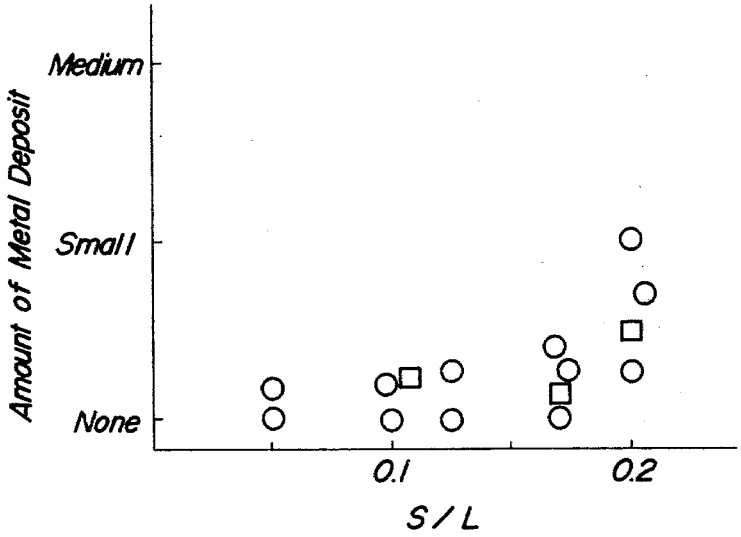
FIG. 3 is a graph showing a relation between the ratio S/L of the tuyere and the amount of metal deposit solidified around the tuyere.

Next, the relation between the growing rate of the metal deposit and the ratio S/L is examined by the following experiment. That is, a small-size converter of 5 ton capacity is used and provided at its bottom with a tuyere for the blowing of the agitating gas having a circular or square section. The blowing is made by passing a pure oxygen gas through a lance onto a blast furnace molten iron until a carbon content of the molten iron is 0.025–0.05% and passing a nitrogen gas through the tuyere in a quantity of 0.3–0.01 $Nm^3$/ton.min. In this experiment, the tuyere is made of SUS 304 stainless steel, the height of the lance for oxygen blowing is 1.0–1.5 m, and the quantity of oxygen gas blown is 1–4 $Nm^3$/ton.min. After the completion of the blowing, the amount of the metal deposit formed around the tuyere is observed to obtain a result as shown in FIG. 3, wherein an abscissa represents numerical value of the ratio S/L and an ordinate represents the amount of the metal deposit formed around the tuyere. In FIG. 3, symbol o is the tuyere of circular section and symbol □ is the tuyere of square section.

As apparent from FIG. 3, the formation of metal deposit is completely or substantially prevented when the tuyere satisfies the ratio S/L of not more than 0.17 irrespective of its section.

In the bottom tuyere according to the invention, when the sectional shape of the tuyere is a circle having an inner diameter R, the ratio S/L is $$\frac{\pi\left(\frac{R}{2}\right)^2}{2\pi\left(\frac{R}{2}\right)} = \frac{R}{4}.$$

Therefore, in order to realize $$S/L\left(=\frac{R}{4}\right) \leqq 0.17,$$

the inner diameter of the tuyere is not more than 0.68 cm (i.e. 6.8 mmϕ). On the other hand, when the sectional shape of the tuyere is a square having an inner side a, the ratio $$S/L \text{ is } \frac{a^2}{4a} = \frac{a}{4}.$$

Therefore, in order to realize $$S/L\left(=\frac{a}{4}\right) \leqq 0.17,$$

the inner side a of the tuyere is not more than 0.68 cm. Moreover, if the sectional shape of the tuyere is a rectangle, the ratio S/L≦0.17 may be achieved when at least one inner side of the rectangle is not more than 0.68 cm.

As the material of the tuyere, use may be made of any heat resistant material having an excellent oxidation resistance at an elevated temperature and a sufficient strength. Among them, the use of heat resisting steels and stainless steels, particularly SUS 304 stainless steel, which is commercially available and excellent in workability, is preferable.

Moreover, the thickness of the tuyere is dependent upon the strength, melting loss and the like, but it is usually within a range of 0.5–3 mm.

In the actual operation for mass production using the oxygen top-blown converter provided at its bottom with the tuyere for the agitating gas, it is desired that there is no fear of causing the leakage of molten steel through the tuyere and the melting loss of the tuyere is reduced to prolong the tuyere life in addition to the prevention of metal deposit formation or tuyere clogging as mentioned above. In this connection, the behavior of the tuyere according to the invention is examined in order to prevent the leakage of molten steel and reduce the melting loss of the tuyere.

Figure 4:
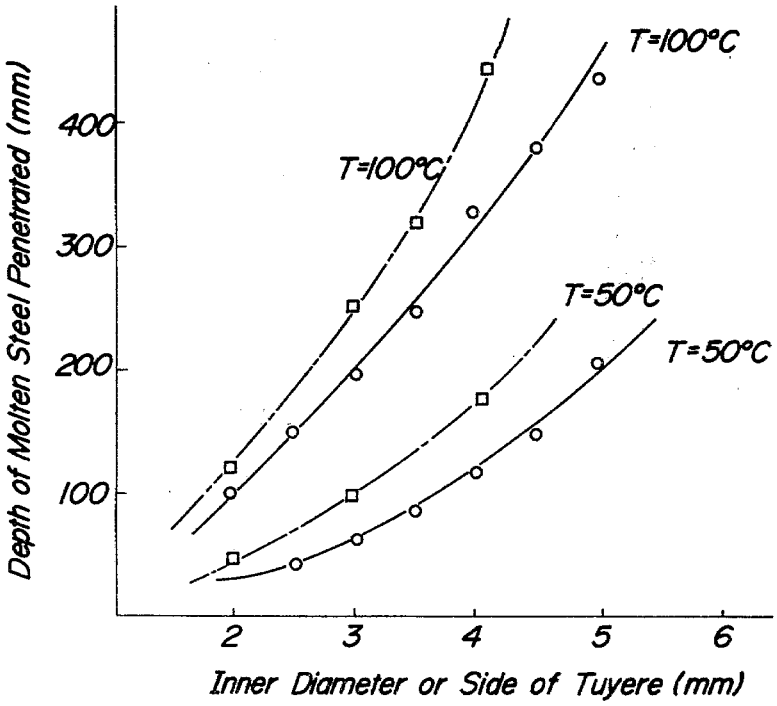
FIG. 4 is a graph showing a relation between the inner diameter or side of the tuyere and the depth of molten steel penetrated into the tuyere.

In the actual operation, there is usually used an oxygen top-blown converter having at its bottom a brick thickness of about 800 mm, whose life corresponding to at least 800 charges. The tuyere of a circular or square section having different inner diameter or side is arranged in the bottom of this converter. During the oxygen blowing, the temperature ΔT of molten steel near the tuyere is maintained at 50° C. or 100° C. higher than the liquidus line of molten steel. After the stop of the blowing, the depth of molten steel penetrated into the tuyere is measured to obtain a result as shown in FIG. 4, wherein an abscissa represents the inner diameter or side of the tuyere and an ordinate represents the depth of molten steel penetrated. In FIG. 4, symbol o represents the tuyere of circular section and symbol □ represents the tuyere of square section.

Figure 5:
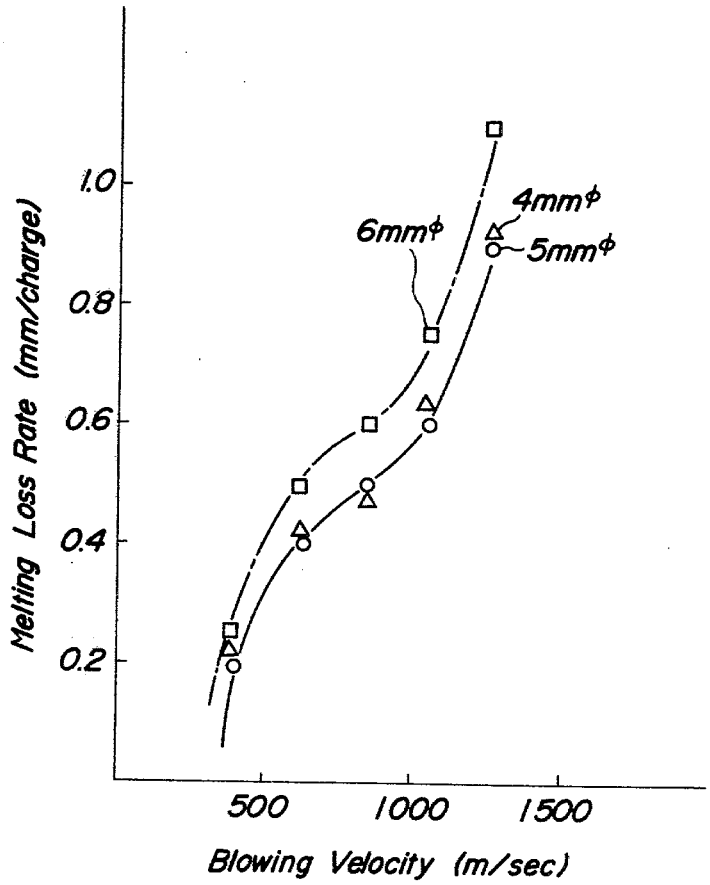
FIG. 5 is a graph showing a relation between the gas blowing velocity and the melting loss of the tuyere.

Further, the above experiment was repeated by changing the blowing velocity of the agitating gas in the bottom tuyere of circular section to obtain a result relating to the melting loss rate per one charge of the tuyere as shown in FIG. 5, wherein an abscissa represents the blowing velocity and an ordinate represents the melting loss rate. In FIG. 5, symbol Δ represents the tuyere having an inner diameter of 4 mm, symbol o represents the tuyere having an inner diameter of 5 mm and symbol □ represents the tuyere having an inner diameter of 6 mm.

Considering that the charge number of molten steel is at least 800 times in the actual operation using the aforementioned converter in accordance with the usual blowing velocity of the agitating gas of about 800 m/sec, it is desirable that the depth of molten steel penetrated into the tuyere is 400 mm at most and the melting loss rate of the tuyere is 0.5 mm at most. As apparent from FIGS. 4 and 5, these requirements are achieved when the tuyere has an inner diameter of not more than 5 mm in circular section or at least one inner side of not more than 4 mm in square section. For instance, when using the tuyere of circular section having an inner diameter of 5 mm, if the agitating gas blowing is stopped by an accident during the oxygen blowing, molten steel remains and solidifies in the tuyere, whereby the leakage of molten steel through the tuyere is prevented.

Calculating from the inner diameter of 5 mm, the ratio S/L of the tuyere is 0.125. That is, the tuyere according to the invention is preferable to have the ratio S/L of not more than 0.125 in view of the prevention of metal deposit formation, prevention of molten metal leakage and reduction of tuyere melting loss. In the tuyere of square section, at least one inner side of 4 mm fulfils the same function as in the case that the inner diameter of the circular tuyere is 5 mm.

On the other hand, if the inner diameter of the circular tuyere is too small, it is apt to cause the clogging of the tuyere with grains of refractory, troubles in maintenance and the like. Therefore, it is desirable that the tuyere has an inner diameter of not less than 2 mm in circular section or at least one inner side of not less than 1 mm in square section.

According to the invention, the tuyere of the above mentioned structure is arranged at the predetermined position in the bottom of the oxygen top-blown converter in order to efficiently agitate molten steel for the improvement of the refining effect.

The position of the tuyere to be arranged is determined as follows. The contact behavior between slag and molten steel during the blowing is observed by changing the position of the tuyere (a distance $r_t$ measured from the central axis of converter) in top and bottom-blown experimental converter (inner diameter of converter: $2r_o$). In this case, liquid paraffin having a specific gravity of 0.85 and containing $\beta$-naphthol is used instead of slag and water is used instead of molten steel. This water-liquid paraffin system is regarded to exhibit the same contact behavior as in the slag-molten steel system. When air is blown on the liquid surface through a lance and simultaneously passed into the liquid through the tuyere, the liquid paraffin is mixed with water, whereby $\beta$-naphthol is dissolved out from liquid paraffin into water. Moreover, the contact point between the liquid paraffin and water is shifted to a distance $r_j$ measured from the central axis of the converter during the blowing of air through the lance. In this way, the quantity of $\beta$-naphthol dissolved out from the liquid paraffin is measured as a contact behavior index between the slag and molten steel to obtain a result as shown in FIG. 6, wherein an abscissa represents the position of the tuyere expressed by $r_t/r_o$ and an ordinate represents the quantity of $\beta$-naphthol dissolved out ($K_B a$, $cm^3/min$).

Figure 6:
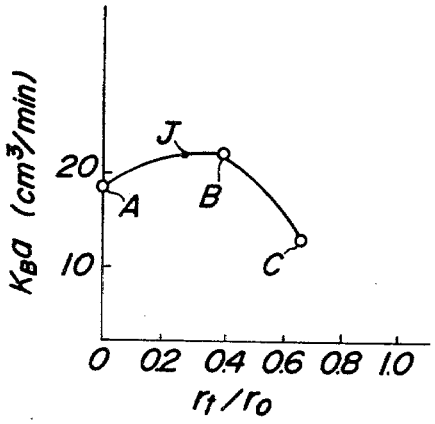
FIG. 6 is a graph showing a relation between the position of the bottom tuyere and the contact behavior index for the improvement of the refining effect.

As apparent from FIG. 6, the position of the tuyere is most effective for the improvement of the refining effect in a point B rather than points A and C. In FIG. 6, point J corresponds to the distance $r_j$. The position $r_t$ of the tuyere in the point B is about 1.4 times of the distance $r_j$ or the jet area of the gas blown through the lance onto the molten steel. This fact shows that the agitating of molten steel becomes more effective by arranging the tuyere for the agitating gas at a position corresponding to the point B in the bottom of the converter. Furthermore, it has been confirmed from the experiment using the water-liquid paraffin system that the relationship of $r_t$=about 1.4 $r_j$ indicating the most effective agitating position of the tuyere is substantially unchanged even when changing the lance height within a range corresponding to the moving range of the lance in the actual operation.

In the actual top-blown converter, the lance height is gradually lowered, during which the refining of molten steel is performed. Now, when a height of the lance at the beginning of the slopping is $H_1$, the jet area of oxygen gas is $r_{j1}$, while when a height of the lance hardly causing the slopping is $H_2$, the jet area of oxygen gas is $r_{j2}$. Therefore, when the tuyere according to the invention is arranged in the bottom of the top-blown converter, the position $r_t$ of the tuyere is preferably within a range of $1.4\ r_{j2} \leqq r_t \leqq 1.4\ r_{j1}$ as apparent from the above experimental results using the water-liquid paraffin system. Particularly, the slopping phenomenon is conspicuous at an initial stage of the oxygen blowing, so that the position $r_t$ of the tuyere is most favorable to be about 1.4 $r_{j1}$ in view of the reduction of slopping. That is, when the tuyere is arranged in a position of $r_t \simeq 1.4\ r_{j1}$, the agitating effect of molten steel becomes higher at the initial stage of the oxygen blowing, so that the occurrence of slopping is considerably suppressed to improve the refining effect of molten steel.

In the actual operation using the top-blown converter of 200 ton capacity, when the jet area $r_j$ of oxygen gas is about 570–730 mm, the four bottom tuyeres for the agitating gas are arranged at the position of $r_t$=about 1,000 mm or 1,500 mm. As a result, the tuyere arrangement of $r_t$=about 1,000 mm tends to reduce the remaining FeO in the slag after the completion of the blowing and hence improves the yield and the reduction of slopping as compared with the tuyere arrangement of $r_t$=1,500 mm.

From these results, it is apparent that the refining effect is most efficiently achieved in the actual operation when the bottom tuyere according to the invention is arranged at a position $r_t$ satisfying the relationship of $1.4\ r_{j2} \leqq r_t \leqq 1.4\ r_{j1}$, preferably $r_t \simeq 1.4\ r_{j1}$.

According to the invention, the number of the bottom tuyeres to be used is 3–10, preferably 4–6. When the number of tuyeres is 1 or 2, there is no agitating effect, while when the number of tuyeres exceeds 10, the refining effect is less due to the overagitating.

As mentioned above, when the tuyere according to the invention having a single pipe structure is applied to the oxygen top-blown converter, the agitating of molten steel is more efficiently achieved without causing the clogging of the tuyere due to overcooling as compared with the case of only the oxygen top-blowing. Furthermore, the quantity of the agitating gas used can be fairly reduced as compared with the case of using the conventional double pipe tuyere, and yet the tuyere and the refractory surrounding therearound are sufficiently cooled, so that the tuyere life can be prolonged with the reduction of the melting loss.

What is claimed is:

1. In a bottom tuyere usable for blowing an agitating gas into molten steel in an oxygen top-blown converter, the improvement wherein said tuyere has a ratio of blow sectional area S ($cm^2$) to inner peripheral length L (cm) of not more than 0.17.

2. The bottom tuyere as claimed in claim 1, wherein said ratio S/L is not more than 0.125.

3. The bottom tuyere as claimed in claim 1, wherein said tuyere has a circular section having an inner diameter of not more than 5 mm.

4. The bottom tuyere as claimed in claim 1, wherein said tuyere has a square section having at least one inner side of not more than 4 mm.

5. The bottom tuyere as claimed in claim 1, wherein said tuyere is made of a material selected from heat resisting steels and stainless steels.

* * * * *